US010746499B2

(12) United States Patent
Munsell

(10) Patent No.: US 10,746,499 B2
(45) Date of Patent: Aug. 18, 2020

(54) TAPERED ARROW LAUNCHER

(71) Applicant: HAMSKEA ARCHERY SOLUTIONS LLC, Frederick, CO (US)

(72) Inventor: Andrew W. Munsell, Brighton, CO (US)

(73) Assignee: Hamskea Archery Solutions LLC, Frederick, CO (US)

( * ) Notice: Subject to any disclaimer, the term of this patent is extended or adjusted under 35 U.S.C. 154(b) by 0 days.

(21) Appl. No.: 16/299,988

(22) Filed: Mar. 12, 2019

(65) Prior Publication Data

US 2020/0041225 A1 Feb. 6, 2020

Related U.S. Application Data

(60) Provisional application No. 62/714,003, filed on Aug. 2, 2018.

(51) Int. Cl.
*F41B 5/22* (2006.01)
*F41B 5/14* (2006.01)

(52) U.S. Cl.
CPC ..... *F41B 5/143* (2013.01)

(58) Field of Classification Search
CPC ..... F41B 5/143; A47L 13/08; B44D 3/164
See application file for complete search history.

(56) References Cited

U.S. PATENT DOCUMENTS 150,117 A * 4/1874 Weston ..... 30/169
1,527,561 A * 2/1925 Klum ..... B44C 7/02 30/169
4,476,846 A 10/1984 Carville
4,664,093 A 5/1987 Nunemaker
4,686,956 A 8/1987 Troncoso, Jr.
4,827,895 A 5/1989 Troncoso, Jr.
5,117,803 A 6/1992 Johnson
5,386,814 A 2/1995 Denton
5,429,107 A * 7/1995 Troncoso, Jr. ..... F41B 5/143 124/24.1
5,606,962 A 3/1997 Troncoso
5,678,530 A 10/1997 Van Drielen
5,960,779 A 10/1999 Jessee et al.
6,089,216 A 7/2000 Harwath et al.
6,363,924 B1 4/2002 Adams, Jr.
6,591,823 B1 7/2003 Keller
6,595,195 B1 7/2003 Barner et al.
6,732,395 B2 * 5/2004 Gringer ..... A47L 13/022 15/105
7,717,103 B2 5/2010 Johnson
8,333,180 B2 12/2012 Mizek
(Continued)

*Primary Examiner* — John A Ricci

(74) *Attorney, Agent, or Firm* — Trenner Law Firm, LLC; Mark D. Trenner

(57) ABSTRACT

A tapered arrow launcher is disclosed as it may be implemented with an arrow launch platform (or arrow rest) for an archery bow. An example tapered arrow rest launcher may include an arrow support end, and a mounting end. The arrow support end of the arrow rest launcher is thinner than the mounting end, resulting in a thickness that is tapered along one or more sections. With this arrangement, fatigue forces and work hardening forces do not concentrate at the mounting end of the tapered arrow launcher when arrows are launched with the arrow launch platform.

15 Claims, 13 Drawing Sheets

(56) References Cited

U.S. PATENT DOCUMENTS

| | | | | |
|---|---|---|---|---|
| 8,342,161 | B2 | 1/2013 | Harwath et al. | |
| 8,752,536 | B2 | 6/2014 | Sims et al. | |
| 8,875,687 | B1 | 11/2014 | Huang et al. | |
| 9,829,270 | B2 * | 11/2017 | Summers | F41B 5/14 |

* cited by examiner

TAPERED ARROW LAUNCHER

CROSS REFERENCE TO RELATED APPLICATIONS

This application claims the priority benefit of U.S. Provisional Patent Application No. 62/714,003 filed Aug. 2, 2018 for "Arrow Support Launcher" of Andrew W. Munsell, hereby incorporated by reference in its entirety as though fully set forth herein.

BACKGROUND

An arrow launch platform or arrow rest launcher is a part of an arrow rest in a modern archery bow. An example of an arrow launch platform is a cantilevered structural element that supports the arrow in all orientations (e.g., up, down, left, right). The cantilevered element is commonly referred to as the launcher.

Existing arrow launchers are of uniform thickness, and can be made from a variety of materials including solid steel, spring steel, polymers, composites, and laminates. The thickness of the launcher is selected for a variety of reasons. For example, a uniformly thick launcher (e.g., greater than 0.03 inches) may be provided for very rigid hunting applications where the arrows tend to be heavier. A uniformly thin launcher (e.g., about 0.012 inches to 0.008 inches) may be provided to comply or yield under the dynamic load of a launched arrow, and then return to its original form.

In mechanical arrow launchers, the sudden stopping of the rotating mechanisms by which the launcher is mounted causes the launcher to oscillate like a diving board. These oscillation cycles work-harden and fatigue the launcher at the mounting end, eventually resulting in failure. This happens in spring steel materials and even in composites and laminates. To prevent this, a thicker and heavier launcher may be used, but this does not offer the flexibility (yielding) of the thinner launcher for lighter arrows, making them less accurate. The problem has also been addressed by adding an additional shorter launcher underneath the uniform launcher, much like a leaf spring.

DETAILED DESCRIPTION

An arrow rest (also referred to herein as an arrow launch platform) may be provided for an archery arrow rest that holds, supports and positions an arrow in all phases of launching the arrow. A tapered arrow launcher is disclosed herein as it may be provided for any of a variety of different arrow launch platforms. In an example, the tapered arrow launcher has a tapered side profile thickness. The tapering of the tapered arrow launcher provides a non-linear spring constant (equivalent to a leaf spring but without the drawbacks mentioned above) in a single monolithic structure.

In an example, the tapered arrow launcher has a design that is thicker at one end (the mounting end) and thinner at the opposite end (the arrow support end). The taper can be selected based for different applications (hunting, target), arrow launch platform types, and/or launcher response needs.

Before continuing, it is noted that as used herein, the terms "includes" and "including" mean, but is not limited to, "includes" or "including" and "includes at least" or "including at least." The term "based on" means "based on" and "based at least in part on."

Figure 1A:
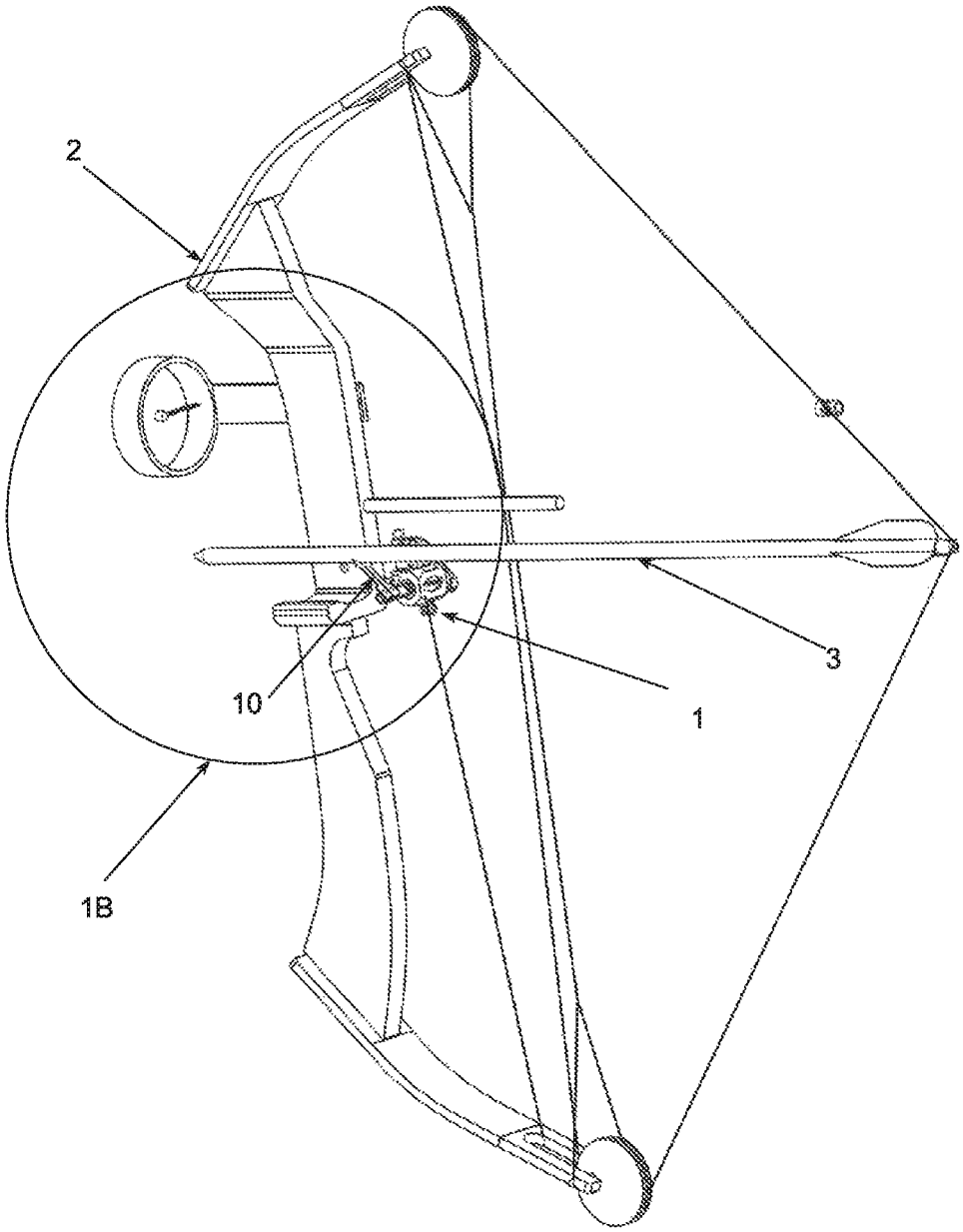
FIG. 1A shows an example arrow launch platform including the tapered arrow launcher disclosed herein, as the arrow launch platform may be mounted on a compound bow.
Figure 1B:
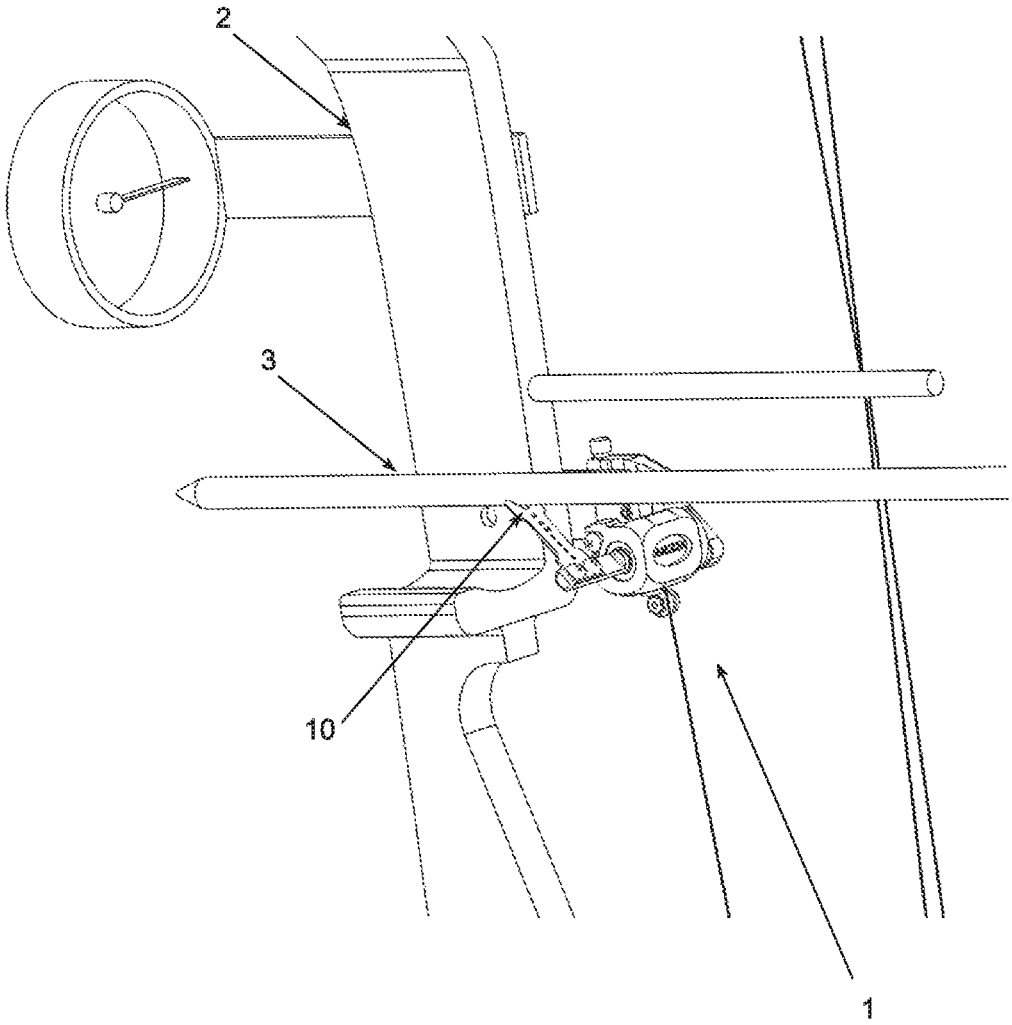
FIG. 1B is a close up view of the example arrow launch platform shown in circle 1B in FIG. 1A.

FIG. 1A shows an example arrow launch platform 1 including the tapered arrow launcher 10 disclosed herein for an arrow rest or arrow launch platform 1 as it may be mounted on a compound bow 2. FIG. 1B is a close up view of circle 1B in FIG. 1A, showing the tapered arrow launcher 10 mounted on the arrow launch platform 1 in more detail.

There are at least three general types of arrow launch platforms on the market today that may implement the tapered arrow launcher 10. A fixed or static arrow launch platform has no moving parts. A fall-away arrow launch platform includes a rotating arrow rest rod that rotates down and away from the arrow shaft via an internal torsional spring during launch. A limb actuated arrow launch platform operates by a linear force supplied by intra-bow mechanics applied to a rotating arrow rest rod, rotating down and away from the arrow shaft.

Each arrow launch platform 1 has a unique set of applications, and in each case, implementing the tapered arrow launcher disclosed herein can improve accuracy and robustness of launching an arrow 3.

Figure 2:
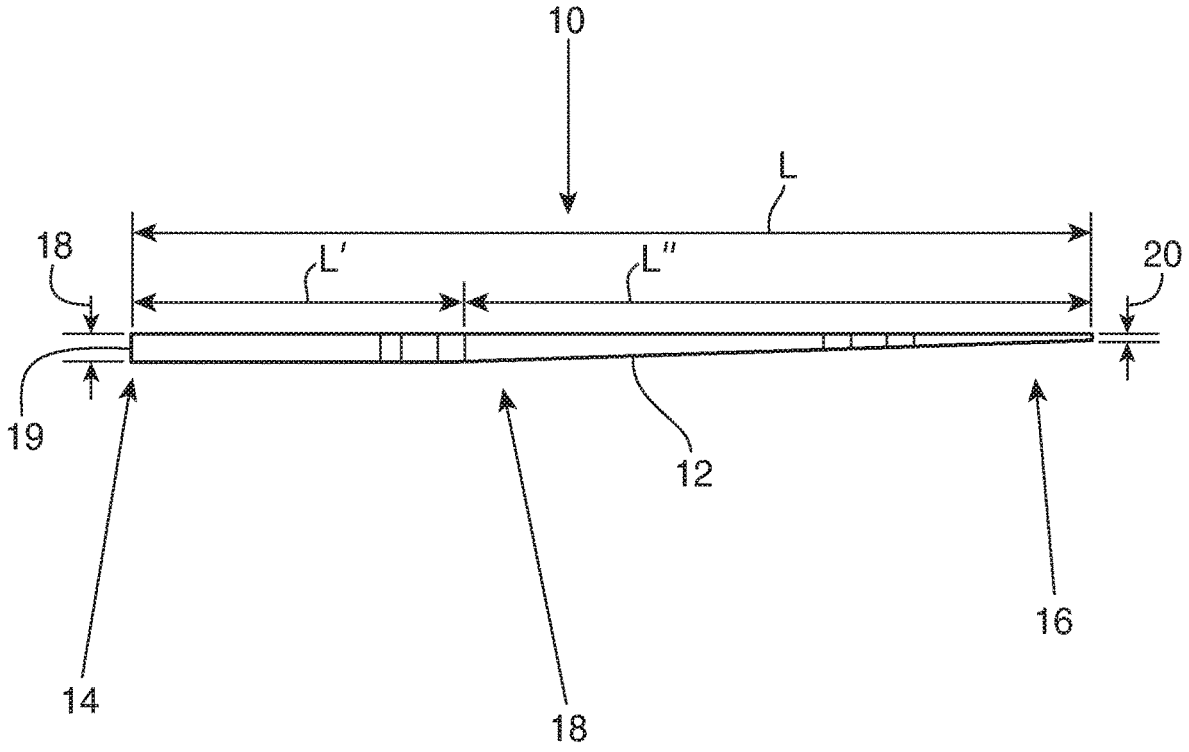
FIG. 2 is a side view of an example tapered arrow launcher.
Figure 3:
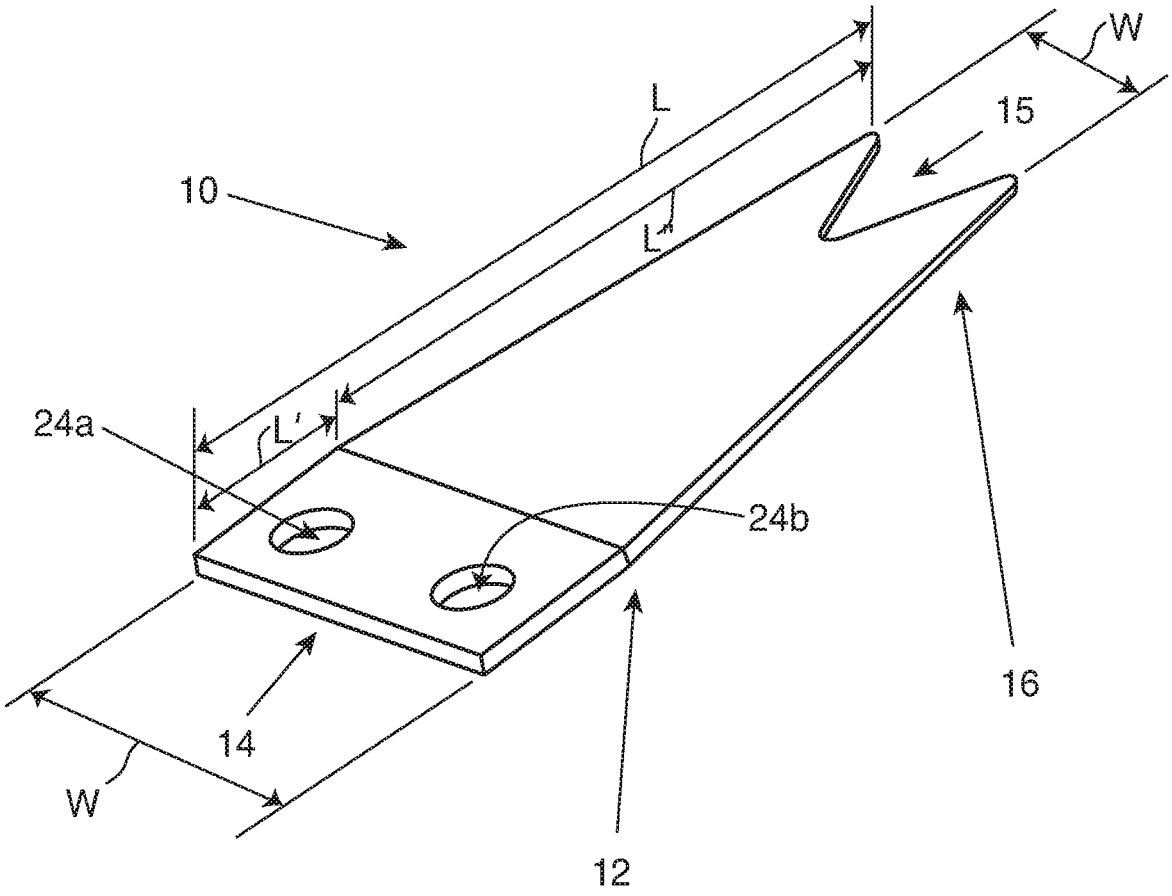
FIG. 3 is a perspective view of another example tapered arrow launcher.

An example tapered arrow launcher 10 for launching an arrow 3 from an arrow launch platform 1 includes a body 12 having a mounting end 14 and an arrow support end 16 (see, e.g., FIGS. 2 and 3). The arrow support end 16 of the body is thinner than the mounting end 14 of the body 12. In an example, the body 12 of the tapered arrow launcher 10 has a tapered linear dimension, i.e., a decreasing thickness along a longitudinal cross section of the body 12 as measured from the mounting end 14 to the arrow support end 16, as explained in more detail below with reference to FIG. 2.

In an example, the mounting end 14 is configured for a connection to the arrow launch platform 1. In an example, the connection has a robustness that is directly proportional to a thickness of the mounting end 14. That is, a thicker mounting end 14 will be less susceptible to breakage and/or loosening of the attachment to the arrow launch platform 1 over time.

In addition, the tapered configuration of the tapered arrow launcher 10 spreads force throughout the body 12 such that fatigue forces do not concentrate at either of the mounting end 14 or the arrow support end 16 during launching of the arrow from the arrow launch platform, thereby further providing enhanced durability.

It is also noted that the tapered configuration of the tapered arrow launcher 10 spreads work hardening forces, such that these forces do not concentrate at either of the mounting end 14 or the arrow support end 16 of the body during launching of an arrow 3 from an arrow launch platform 1.

In addition, the tapered configuration of the tapered arrow launcher 10 provides a dynamic oscillation of the body 12 during arrow launch. This increases accuracy of an arrow 3 launched from an arrow launch platform 1. In an example, the increase in accuracy is inversely proportional to the thickness of the arrow support end 16 of the body. That is, the thinner the arrow support end 16, the higher accuracy that is realized during arrow launch.

Before continuing, it should be noted that the examples described herein are provided for purposes of illustration, and are not intended to be limiting. Other devices and/or device configurations may be utilized to carry out the operations described herein.

FIG. 2 is a side view of an example tapered arrow launcher 10, illustrating a longitudinal profile. In the example longitudinal profile shown in FIG. 2, the tapered arrow launcher 10 has a body 12 extending from one end 14 to the opposite end 16. The taper is selected to provide a non-uniform spring constant and spring rate across the length of the tapered arrow launcher 10, yielding advantageous effects on the physical and modal responses of the tapered arrow launcher 10. The taper provides a compliance at the arrow support end or thin end 16 while providing structural (non-compliance) at the mounting end or thick end 14.

In an example, the tapered arrow launcher 10 includes a thicker mounting end 14 that is tapered across the longitudinal profile such that it leads to a thinner arrow support end 16. It is noted that the longitudinal cross section shown in FIG. 2 is taken substantially through a centerline of the body 12 of the tapered arrow launcher 10 (see, e.g., FIG. 3).

It is noted that the tapered arrow launcher 10 necessarily has more than one longitudinal cross section, taken at various locations across the width of the body 12 and is not limited to the centerline in that width. In an example, each of the longitudinal cross sections may have the same taper from one end 14 to the opposite end 16. In another example, one or more longitudinal cross sections may have different tapers from one end 14 to the opposite end 16. For example, the longitudinal cross section along the centerline may be thicker than the longitudinal cross section at the two ends. In addition, the taper can be integrated on the centerline, but not necessarily on subsequent longitudinal cross sections. Other configurations are also contemplated, as will be well understood by those having ordinary skill in the art after becoming familiar with the teachings herein.

It is also noted that although the taper illustrated in FIG. 2 is substantially uniform (i.e., steadily decreasing in thickness from the mounting end 14 to the arrow launch end 16), other tapers are also within the scope of the disclosure.

By way of illustration, the taper may include one or more portion of the longitudinal cross section between the mounting end 14 and the arrow launch end 16 which has a substantially constant thickness. For example, at least one longitudinal cross-section of the body 12 may have a substantially uniform thickness, such that vibration modes from one or more tapered sections can be located at a precise point along the length of the body 12.

The specific dimensions and taper of the longitudinal profile (or profiles of various longitudinal cross sections) may depend at least to some extent on the material that the tapered arrow launcher is manufactured from. It is noted that the tapered arrow launcher 10 can be made of any of a variety of materials, including but not limited to, spring steel, laminates, polymers, stainless steel, and composites. These materials may be specific to the desired properties for to a given application (e.g., hunting or target).

In an example, the mounting end 14 of the tapered arrow launcher 10 has a thickness 18 greater than about 0.04 inches. For example, the thickness 18 at the mounting end 14 may be about 0.05 inches. In an example, the mounting end 14 has a uniform thickness. This may help to facilitate attachment to the arrow launch platform 1. For example, the uniform thickness may extend from a forward edge 19 of the mounting end 14 toward the arrow support end 16 for a minority length U. In an example, this uniform thickness 18 throughout length U of the profile is about 0.050 (+1-0.001) inches. The profile for a majority length L" of the body 12 may be tapered, i.e., have a decreasing thickness toward the arrow support end 16 (e.g., where the thickness 20 is about 0.010 inches).

In an example, the length L' of the body 12 may be about 0.548 inches. The length L" of the body 12 may be about 1.580 inches. However, the specific dimensions may vary based on design considerations and is not limited.

Also in this example, the arrow support end 16 has a thickness 20 of between about 0.008 inches and about 0.012 inches.

In an example, the taper results in the body 12 having a smaller mass, when compared to an arrow launcher with a uniform thickness. This smaller mass reduces the overall mass of the arrow launch platform 1, and hence of the bow itself 2.

In an example, the taper results in the body 12 having a center of mass that is positioned closer to the mounting end 14 than to the arrow support end 16. When compared to a launcher having a uniform thickness, the tapered arrow launcher 10 exhibits a better bending moment. This results in a faster response time as the center of gravity being closer to the rotating shaft results of the lower moments of inertia and may also result in a faster response time. In addition, because the center of gravity is closer to the mounting end 14, and hence closer to the center of rotation of the tapered arrow launcher 10, less energy is required to move/rotate the launcher (moment of inertia).

The taper of the body 12 relocates and distributes the bending stresses across the taper area, thereby virtually eliminating the stress concentration found in an arrow launcher having a uniform thickness.

The taper of the body 12 also provides a graduated spring constant and spring rate (e.g., stiffer toward the mounting end 14 and more flexible toward the arrow support end 16). This graduated spring constant enables distribution of bending forces along the length L of the body 12. This improves the service life of the tapered arrow launcher 10, while still providing the robustness of a launcher with uniformly thick profile. That is the mounting end 14 is less susceptible to breakage and wear, while still providing a dynamic response as fast and forgiving as an arrow launcher having a uniformly thin profile.

FIG. 3 is a perspective view of another example tapered arrow launcher 10. In the example shown in FIG. 3, the arrow support end 16 of the tapered arrow launcher 10 has a forked groove 15. The forked groove 15 may serve to hold an arrow 3 in place for launching. Also seen in FIG. 3, the mounting end 14 of the tapered arrow launcher 10 also includes two through-holes 24*a* and 24*b*, through which attachments (not shown) may be fitted to connect the tapered arrow launcher 10 to the arrow launch platform 1.

In the example shown in FIG. 3, the tapered arrow launcher has a tapered width between mounting end 14 and the arrow support end 16. That is, the width may be wider at the mounting end 14 than the width at the arrow support end 16.

Figure 4A:
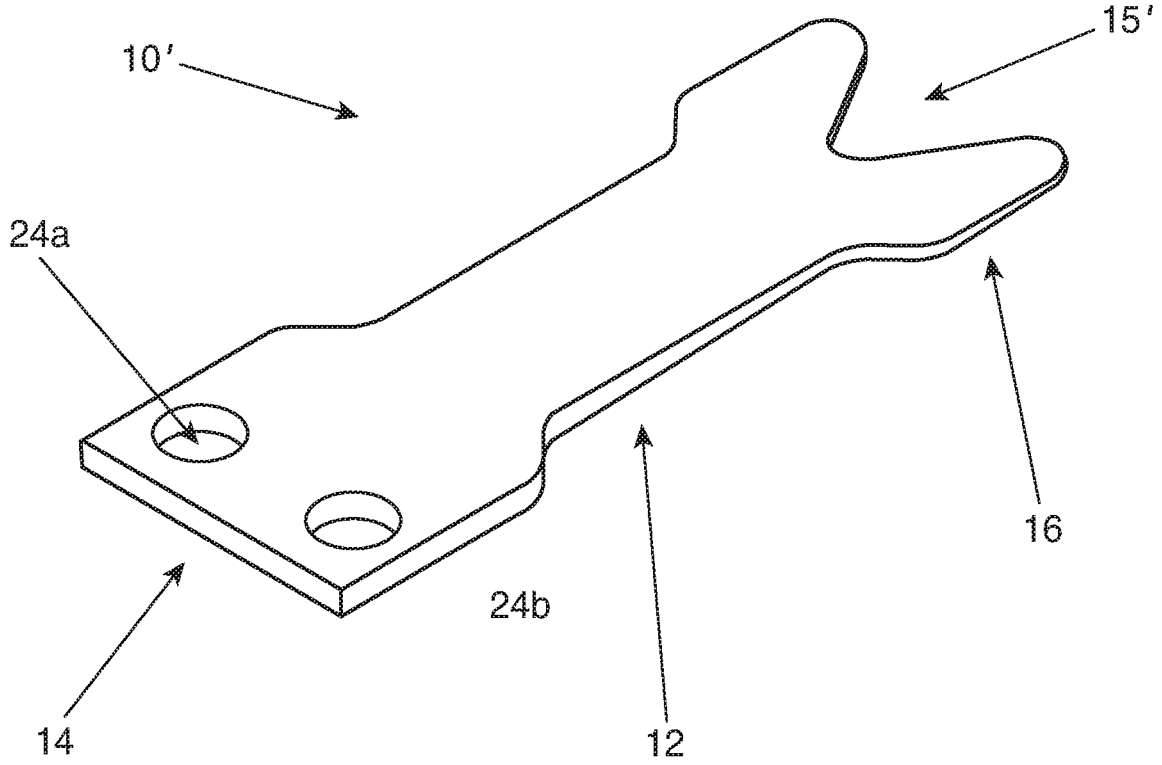
FIG. 4A is a perspective view of another example tapered arrow launcher.
Figure 4B:
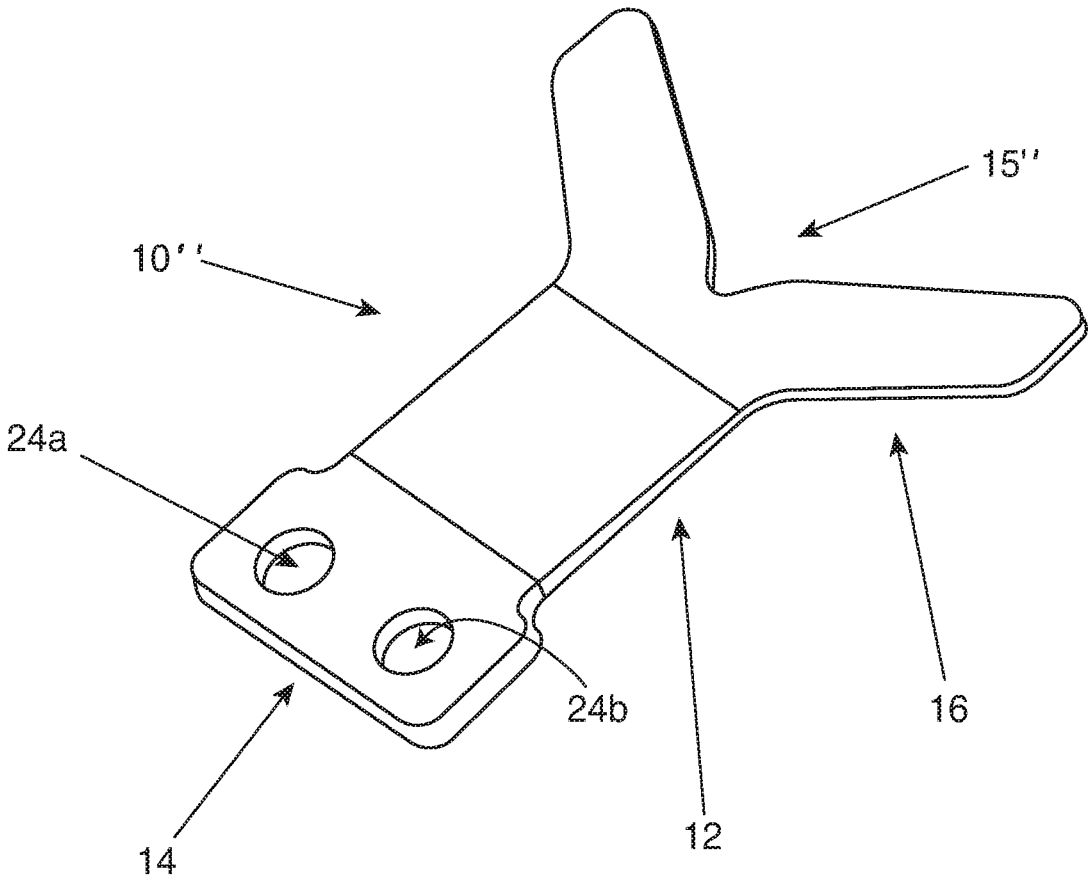
FIG. 4B is a perspective view of another example tapered arrow launcher.

Still other configurations of the tapered arrow launcher 10 are also contemplated. By way of illustration, FIG. 4A is a perspective view of another example tapered arrow launcher 10'. FIG. 4B is a perspective view of another example tapered arrow launcher 10".

Again, the arrow support end 16 of the tapered arrow launcher 10' and 10" may have a thickness of between about 0.008 inches and 0.020 inches, and the mounting end 14 has a thickness of greater than about 0.04 inches. The interface or body length L" is tapered from a thickness equal to that of the mounting end 14 to a thickness equal to that of the arrow support end 16.

In the examples shown in FIGS. 4A and 4B, the interface region has a narrower width than both the mounting end 14 and the arrow support end 16. In the example shown in FIG. 4A, the arrow mounting end also has a forked groove 15'. In the example shown in FIG. 4B, the arrow support end 16 has a wider or flared forked groove 15".

It is noted that the tapered arrow launcher is described herein as it may be implemented with reference to particular types of arrow launch platforms for purposes of illustration. However, the tapered arrow launcher is not limited to implementation with any type of arrow launch platform, and may also have applicability to other arrow launch platforms now known or later developed, as will be understood by those having ordinary skill in the art after becoming familiar with the teachings herein.

Figure 5:
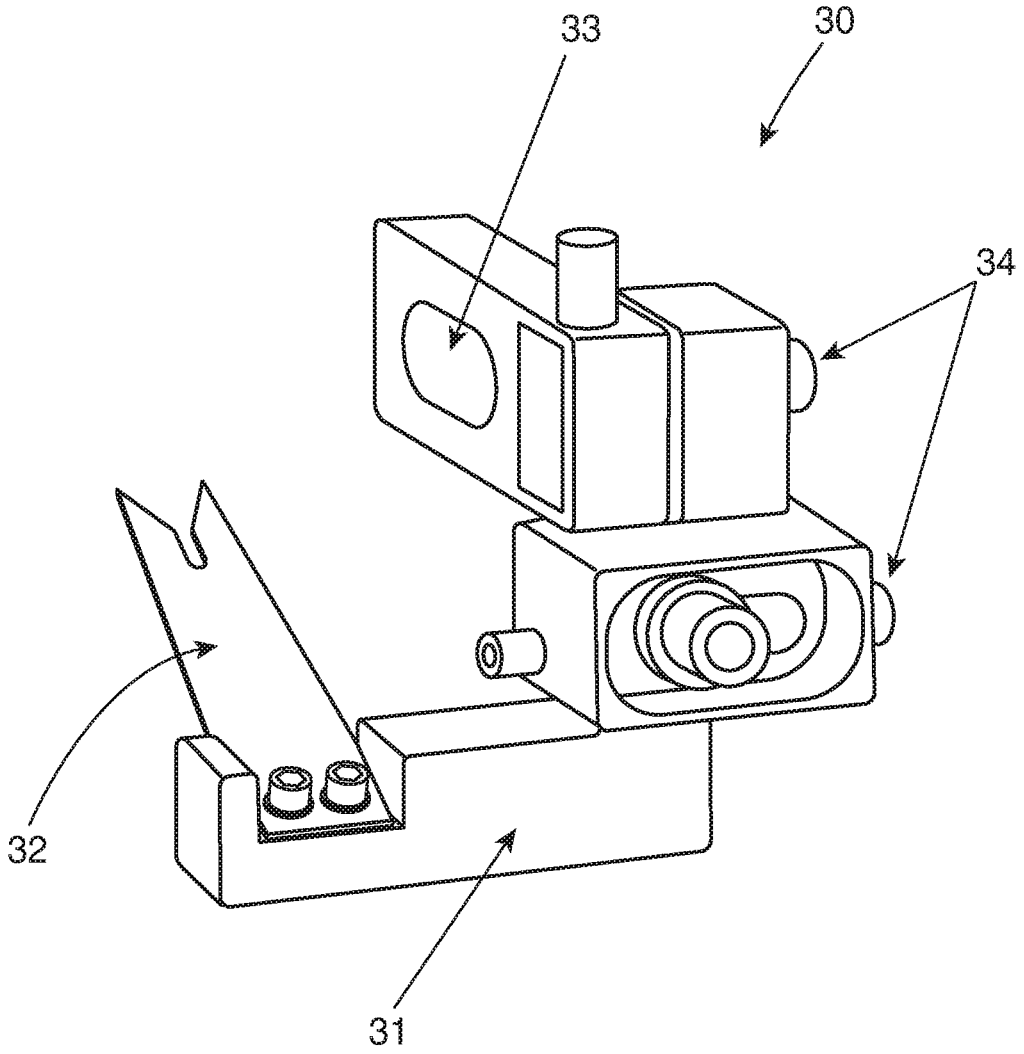
FIG. 5 is a perspective view of an example fixed blade arrow rest including an example tapered arrow launcher, such as the tapered arrow launcher of FIG. 3.

FIG. 5 is a perspective view of an example fixed blade arrow rest 30 including an example tapered arrow launcher, such as the tapered arrow launcher 10 of FIG. 3. Visible are the base 31, tapered arrow launcher 32, and arrow rest position adjusters 33 and 34 (e.g., up/down, left/right).

Thin, uniform-thickness launchers have been exclusively used on the fixed launcher rests in target archery applications, as the thin material bends under the forces imparted on it by a launched arrow. The thin configuration exhibits compliance as an arrow is launching, after which the launcher returns to its original form. The compliance of the thinner material in combination of the arrow's dynamic forces imparted on the launcher provide for a "forgiving" combination that results in improved accuracy. Since these launchers are structurally mounted on one end, the launcher oscillates after the arrow forces are removed, as they essentially become free structural members with their associated modal resonance dominated by the 1st mode. Over time, the work hardening of the material results in a failure: the launcher physically breaking at the mounting edge at the mounting end where the launcher and the rotating shaft edge intersect.

However, by implementing the tapered arrow launcher 10 disclosed herein, the fixed launcher configuration of the fixed blade arrow rest provides for improved performance in each of these regards, as already described above.

Figure 6:
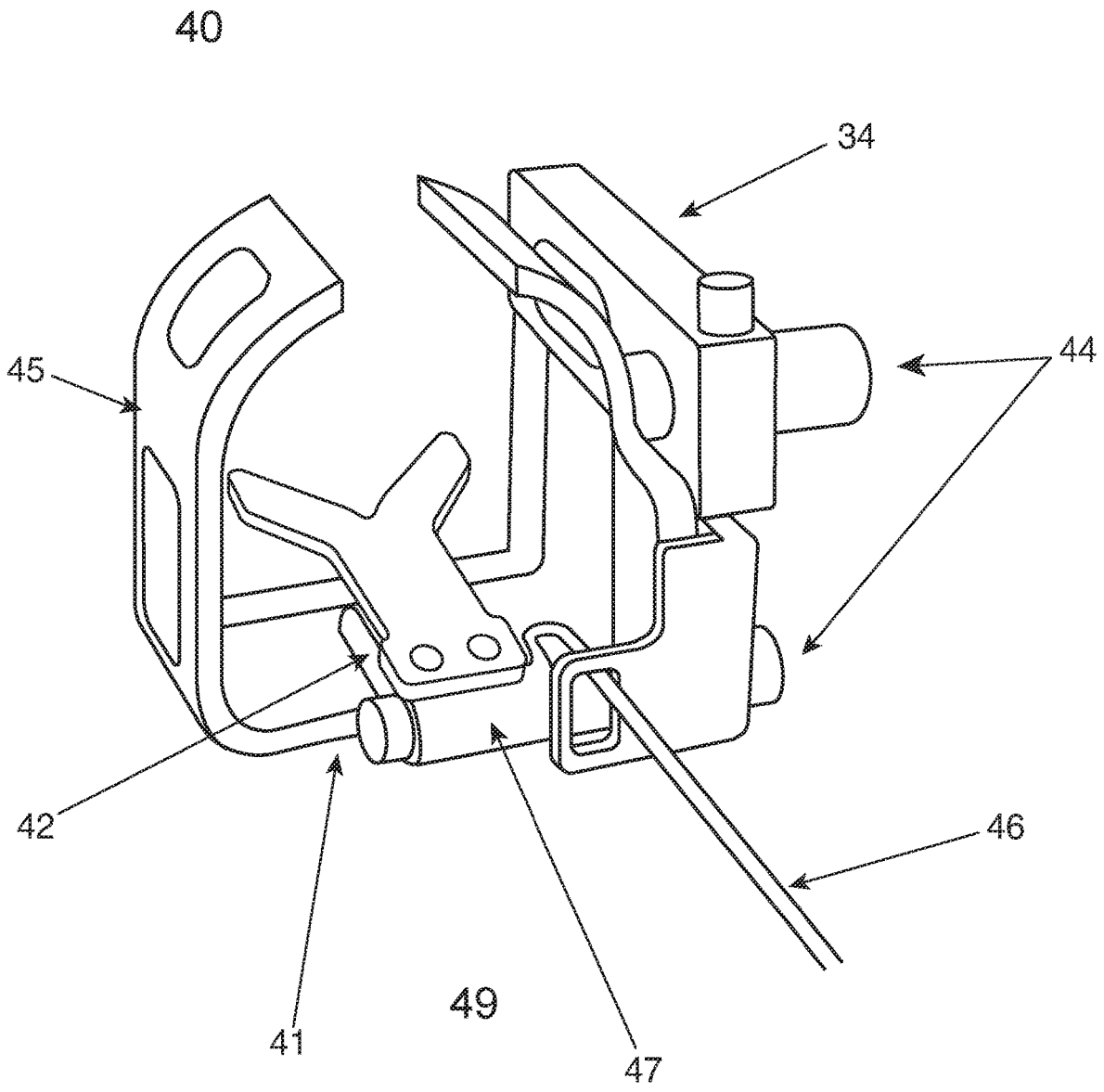
FIG. 6 is a perspective of an example fall-away arrow rest including a tapered arrow launcher, such as the tapered arrow launcher of FIG. 4A or 4B.

FIG. 6 is a perspective of an example fall-away arrow rest 40 including a tapered arrow launcher. The fall-away arrow rest 40 is shown as it may include a base 41, launcher 42, arrow rest position adjusters 43 and 44 (e.g., up/down, left/right), arrow containment bracket 45, and cord 46. Releasing or unloading the cord 46 allows a torsion spring 47 to rotate the launcher to the DOWN position as shown.

While the style of tapered arrow launcher of FIG. 4B is shown as the launcher 42 for purposes of illustration, it is noted that the tapered arrow launcher 10' (or other tapered arrow launchers as disclosed here) may also be implemented with the fall-away arrow rest 40.

The fall-away arrow rest 40 is used primarily for hunting. The nature of the hunting environment lends itself to a very thick metal or composite launcher (e.g., 0.2 inches thick), when compared to the launcher of the thin fixed blade arrow rests (e.g., about 0.04 inches) described above for FIG. 5 (e.g., common in target archery). A thick metal or composite launcher has little or no yield properties under the dynamic forces of a launched arrow. This results in a less forgiving, less accurate launch, but is very robust for the hunting environment. It also has a larger mass.

The tapered arrow launcher 10' is attached to the rotating shaft 49. The typical fatigue-based failure point for a traditional fixed-thickness launcher 42 occurs at the support end, at or near the outer edge of the attachments. But this can be been greatly reduced and/or entirely eliminating by using the tapered arrow launcher 10' disclosed herein.

Figure 7:
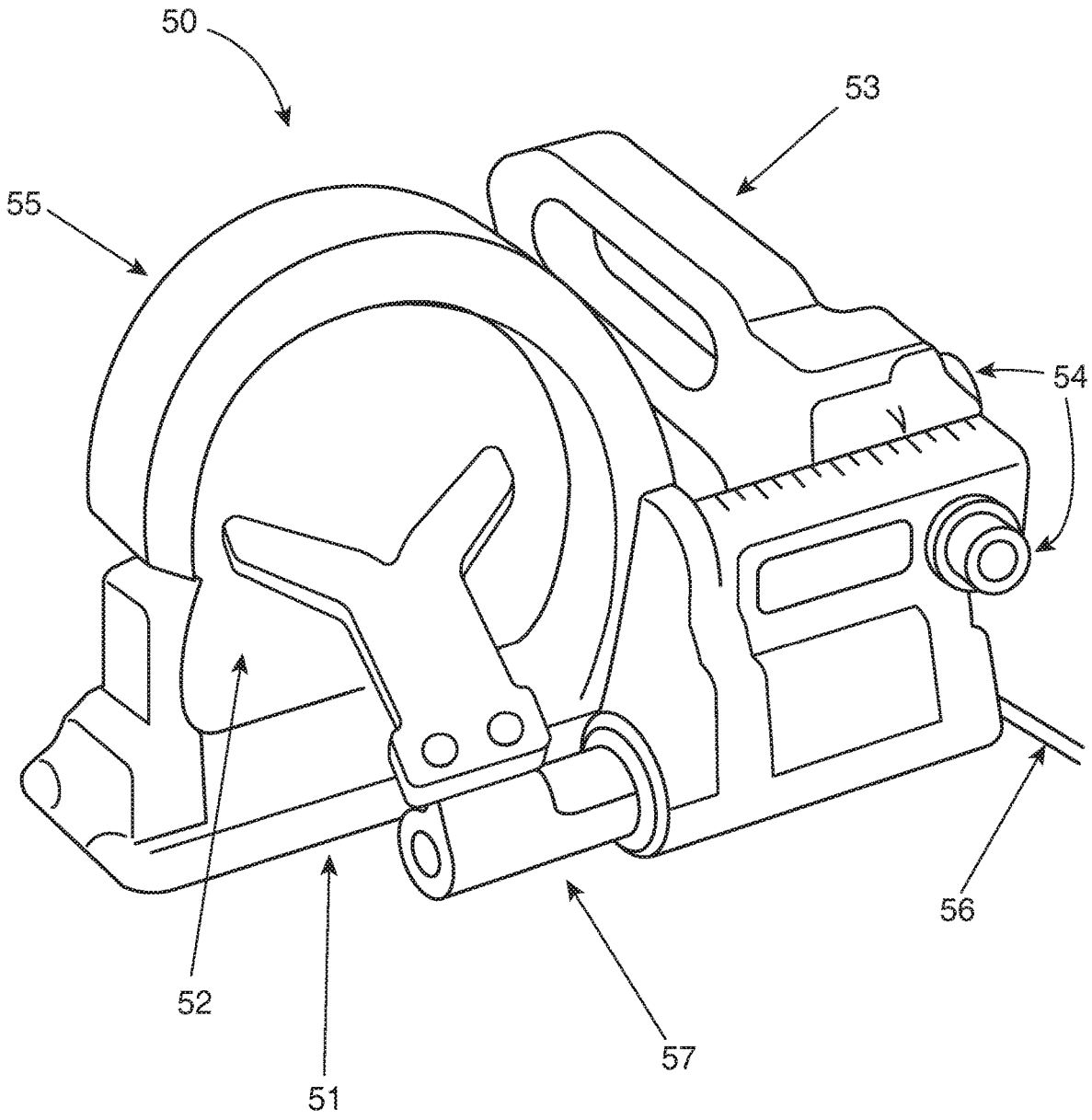
FIG. 7 is a perspective view of an example fall-away arrow rest including the tapered arrow launcher.

FIG. 7 is a perspective view of another example fall-away arrow rest 50 including the tapered arrow launcher 10". In this example, the fall-away arrow rest 50 includes base 51, launcher 52, arrow rest position adjusters 53 and 54 (e.g., up/down, left/right), arrow containment bracket 55, and cord 56. Pulling the cord 56 results in a force that overcomes the torsion spring 57, and rotates the launcher 52 to an UP position.

Again, while the style of tapered arrow launcher 10" of FIG. 4B is shown as the launcher 52 for purposes of illustration, it is noted that the tapered arrow launcher 10' (or other tapered arrow launchers as disclosed here) may also be implemented with the fall-away arrow rest 50.

Figure 8A:
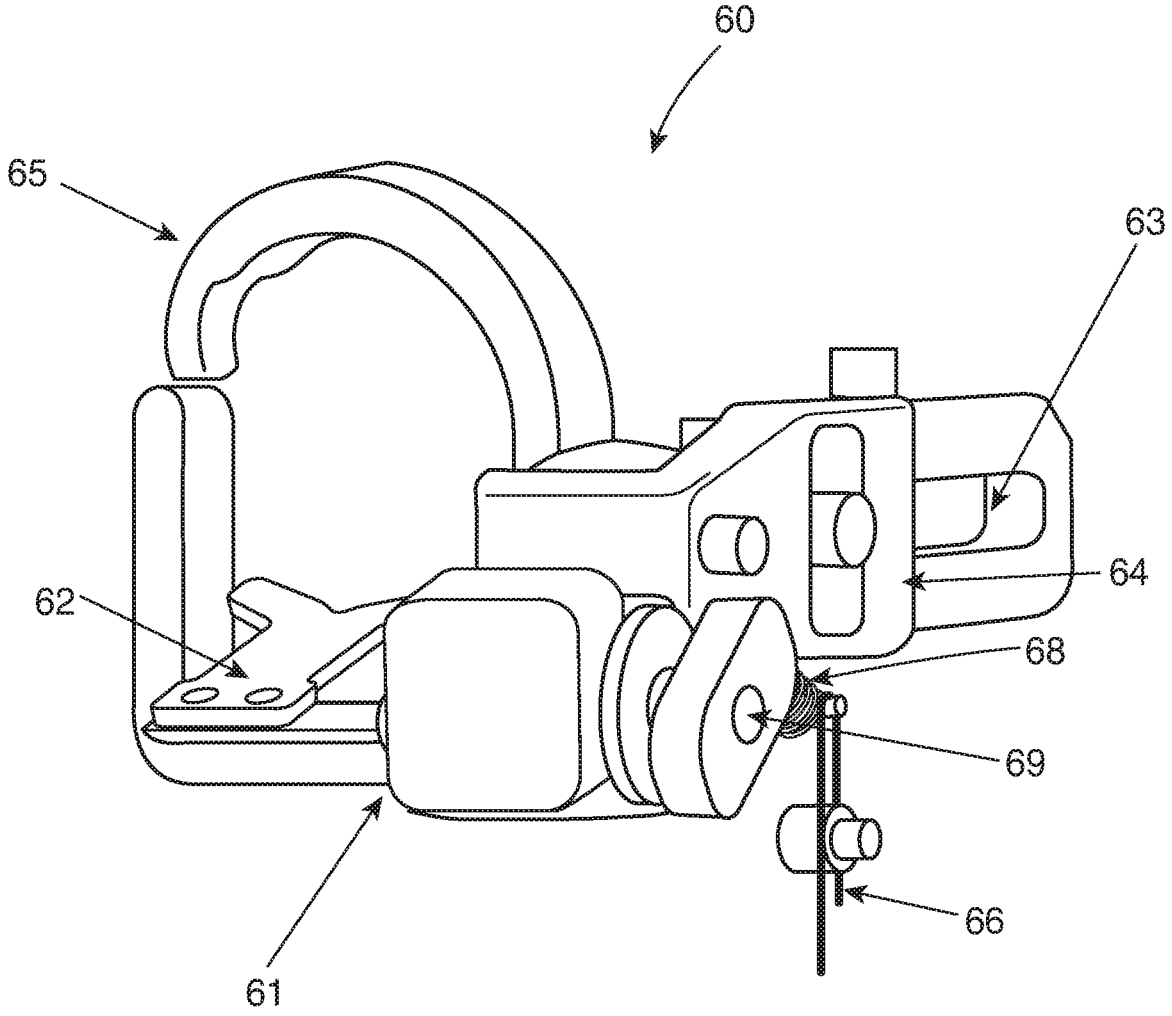
FIG. 8A is a perspective view of an example limb articulated arrow rest including the tapered arrow launcher, shown in a first position.
Figure 8B:
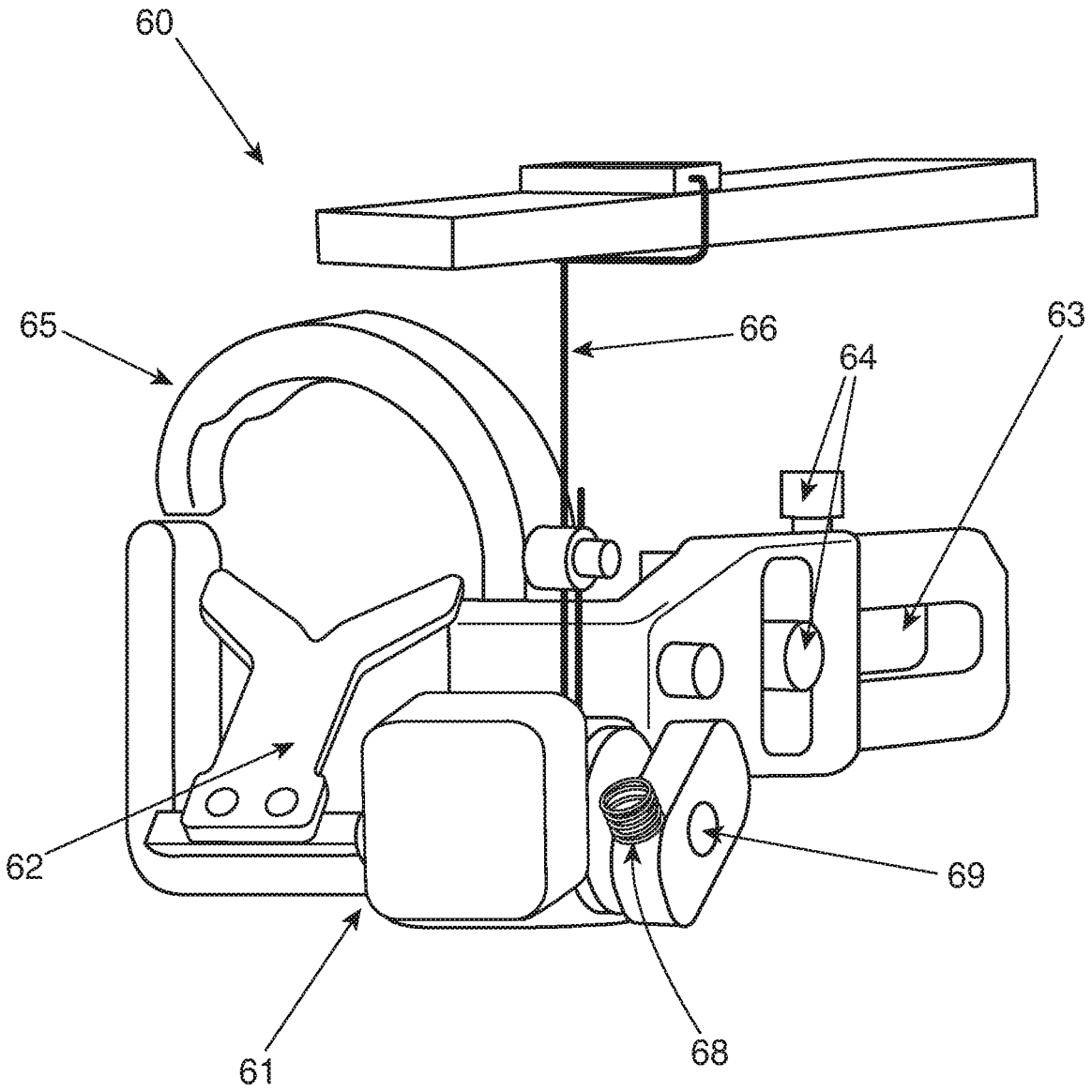
FIG. 8B is a perspective view of the example limb articulated arrow rest of FIG. 8A including the tapered arrow launcher, shown in a second position.
Figure 8C:
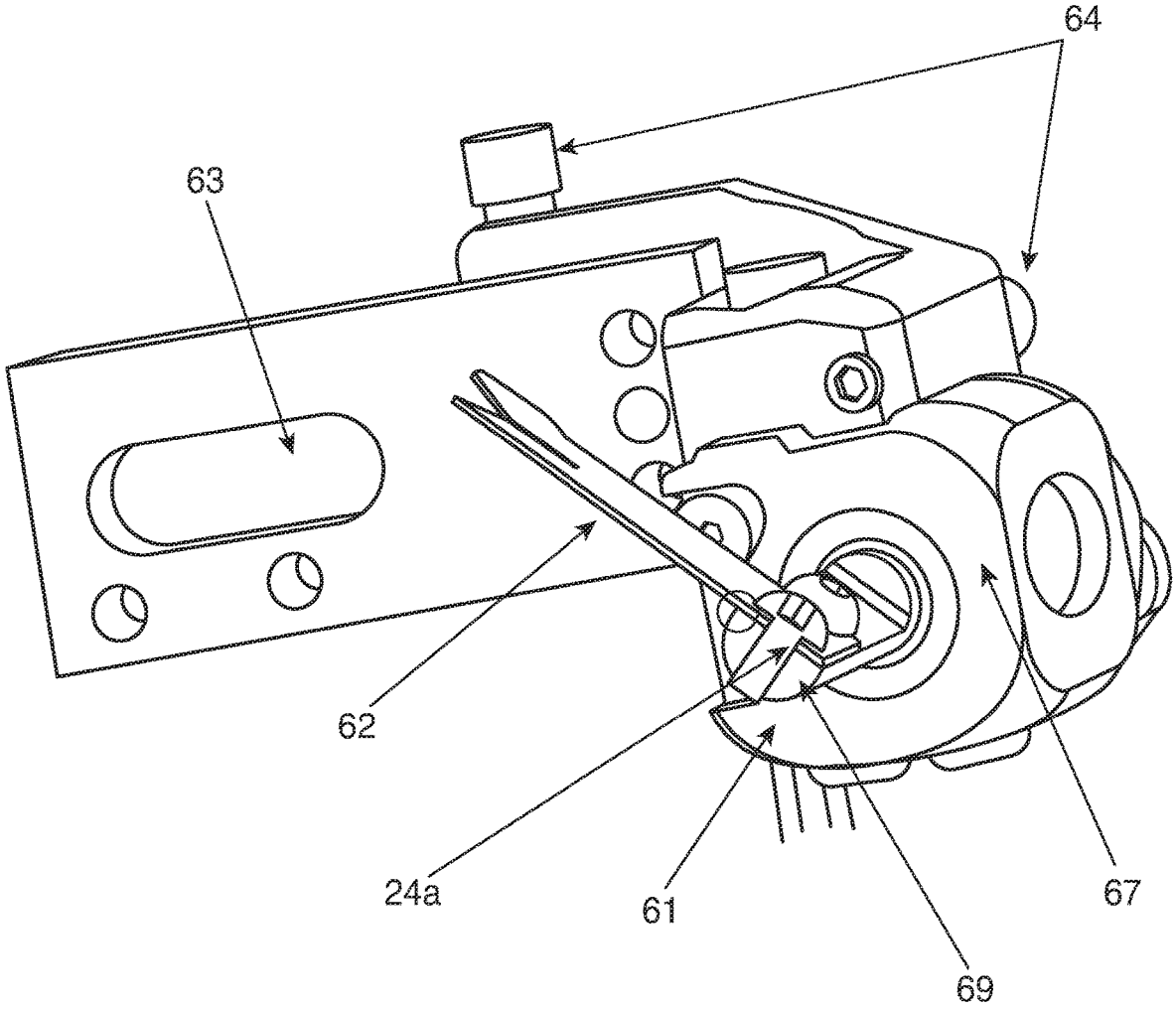
FIG. 8C is a cutaway perspective view of the example limb articulated arrow rest of FIG. 8A showing the tapered arrow launcher.

FIG. 8A is a perspective view of an example limb articulated arrow rest 60 including the tapered arrow launcher 10", shown in a first position. FIG. 8B is a perspective view of the example limb articulated arrow rest 60 of FIG. 8A including the tapered arrow launcher 10", shown in a second position. FIG. 8C is a cutaway perspective view 67 of the example limb articulated arrow 60 rest of FIG. 8A showing the tapered arrow launcher 10".

In this example, the articulated arrow rest 60 includes base 61, launcher 62, arrow rest position adjusters 63 and 64 (e.g., up/down, left/right), arrow containment bracket 65, and cord 66. Again, while the style of tapered arrow launcher 10" of FIG. 4B is shown as the launcher 62 for purposes of illustration, it is noted that the tapered arrow launcher 10' (or other tapered arrow launchers as disclosed here) may also be implemented with the limb articulated arrow rest 60.

Recently, the limb actuated rest has become commonly used in both target and hunting applications. This style of rest uses the cord 66 to transfer the linear intra-bow force to a lever arm 68 that is connected to the rotating shaft 69 of an arrow rest. This impulse force results in higher speeds for rotating the arrow rest rod, which leads to higher angular velocity and centrifugal forces. These forces are transferred into oscillatory resonances in the structure of the launcher as the rotation of the rod is abruptly terminated by a physical stop in the arrow rest.

The momentum of the launcher 62 continues past the physical stop, resulting the launcher to bend and then oscillate. Over many shots, this mechanism of oscillation work-hardens a traditional launcher material to the point of failure. To combat this problem, a thicker material can be used but results in a heavier, stiffer, non-compliant launcher that is slower and not as accurate.

In contrast to the traditional launcher, the tapered arrow launcher 62 disclosed herein provides a lighter launcher that is nevertheless both stiffer and more robust than a traditional launcher. The tapered arrow launcher 52 maintains an element of compliance needed for the most forgiving and accurate results in both target and bowhunting applications.

Figure 9A:
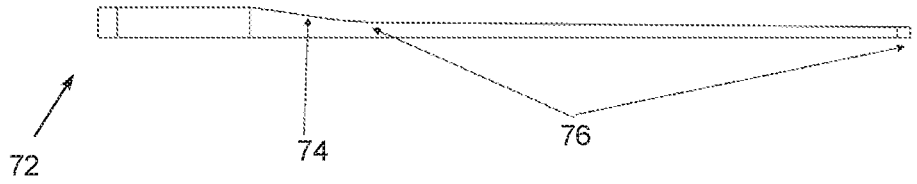
FIGS. 9A and 9B shows a side view (A) and perspective view (B) of another example tapered arrow launcher having more than one taper.
Figure 9B:
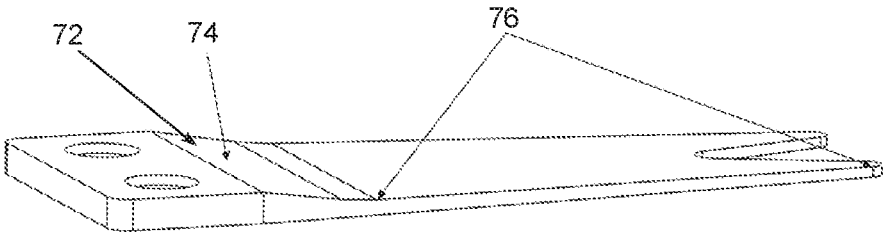

FIGS. 9A and 9B shows a side view (9A) and perspective view (9B) of another example tapered arrow launcher 72 having more than one taper 74 and 76. More tapers (not shown) may also be provided.

The elements and operations shown and described herein are provided to illustrate example implementations. It is noted that the operations are not limited to the ordering shown. Still other elements and operations may also be implemented.

Still further examples may include alternative shapes for the tapered arrow launcher that, as a design choice, provide additional combinations of mass, length spring constant, dynamic response, and robustness.

It is noted that the examples shown and described are provided for purposes of illustration and are not intended to be limiting. Still other examples are also contemplated.

The invention claimed is:

1. A tapered arrow launcher for launching an arrow from an arrow launch platform, comprising:

a body having an arrow support end and a mounting end; and a forked groove;

wherein the arrow support end of the body is thinner than the mounting end of the body, resulting in a thickness that is tapered along one or more longitudinal cross sections between the arrow support end and the mounting end; and wherein the arrow support end has a narrower width than the mounting end.

2. The tapered arrow launcher of claim 1, wherein the mounting end is configured for a connection to the arrow launch platform, the connection having a robustness that is directly proportional to a thickness of the mounting end.

3. The tapered arrow launcher of claim 1, wherein fatigue forces do not concentrate at the mounting end of the body during launching of the arrow from the arrow launch platform.

4. The tapered arrow launcher of claim 1, wherein work hardening forces do not concentrate at the mounting end of the body during launching of an arrow from an arrow launch platform.

5. The tapered arrow launcher of claim 1, wherein a mass of the body is less than a body of uniform thickness equal to a thickness of the mounting end.

6. The tapered arrow launcher of claim 1, further comprising at least one opening formed in the mounting end of the body for attachment to an arrow launch platform.

7. The tapered arrow launcher of claim 1, further comprising at least one longitudinal cross-section of the body having a substantially uniform thickness, such that vibration modes from one or more tapered cross-sections of the body are located at a precise position along the length of the body.

8. The tapered arrow launcher of claim 1, wherein an interface region of the body formed between the mounting end and the arrow support end has a narrower width than the mounting end.

9. The tapered arrow launcher of claim 1, wherein the thickness of the arrow support end is between about 0.008 inches and 0.020 inches, and the thickness of the mounting end is greater than about 0.04 inches.

10. The tapered arrow launcher of claim 1, wherein the mounting end forms a length of the one or more longitudinal cross sections having a uniform thickness.

11. The tapered arrow launcher of claim 1, wherein a center of mass of the body is closer to the mounting end than to the arrow support end.

12. A tapered arrow launcher for launching an arrow from an arrow launch platform, comprising:

a body having an arrow support end and a mounting end, the thickness of the arrow support end being between about 0.008 inches and 0.020 inches, and the thickness of the mounting end being greater than about 0.04 inches; and a forked groove;

wherein the arrow support end of the body is thinner than the mounting end of the body, resulting in a thickness that is tapered along one or more longitudinal cross sections between the arrow support end and the mounting end; and wherein the mounting end forms a length of the one or more longitudinal cross sections having a uniform thickness.

13. A tapered arrow launcher for launching an arrow from an arrow launch platform, comprising:

a body having an arrow support end and a mounting end, the thickness of the arrow support end being between about 0.008 inches and 0.020 inches, and the thickness of the mounting end being greater than about 0.04 inches, a center of mass of the body provided closer to the mounting end than to the arrow support end;

wherein the arrow support end of the body is thinner than the mounting end of the body, resulting in a thickness that is tapered along a majority length of a longitudinal cross section between the arrow support end and the mounting end;

wherein the mounting end forms a minority length of the longitudinal cross section that is a uniform thickness.

14. A tapered arrow launcher for launching an arrow from an arrow launch platform, comprising:

a body having an arrow support end and a mounting end;

at least one longitudinal cross-section of the body having a substantially uniform thickness, such that vibration modes from one or more tapered cross-sections of the body are located at a precise position along the length of the body;

wherein the arrow support end of the body is thinner than the mounting end of the body, resulting in a thickness that is tapered along one or more longitudinal cross sections between the arrow support end and the mounting end; and wherein the arrow support end has a narrower width than the mounting end.

15. A tapered arrow launcher for launching an arrow from an arrow launch platform, comprising:

a body having an arrow support end and a mounting end;

wherein the mounting end forms a length of the one or more longitudinal cross sections having a uniform thickness;

wherein the arrow support end of the body is thinner than the mounting end of the body, resulting in a thickness that is tapered along one or more longitudinal cross sections between the arrow support end and the mounting end; and wherein the arrow support end has a narrower width than the mounting end.

* * * * *